United States Patent [19]

Draney et al.

[11] 4,377,914

[45] Mar. 29, 1983

[54] VERTICAL LIFT AND BLADE CONTROL MECHANISM FOR CABLE PLOWS

[75] Inventors: Robert G. Draney, Wichita; Howard A. Zimmerman, Wellington, both of Kans.

[73] Assignee: J. I. Case Company, Racine, Wis.

[21] Appl. No.: 288,821

[22] Filed: Jul. 31, 1981

[51] Int. Cl.[3] ..... E02F 5/18

[52] U.S. Cl. ..... 37/193; 37/DIG. 18

[58] Field of Search ..... 37/193, 117.5, DIG. 18; 172/140; 405/174, 180–183

[56] References Cited

U.S. PATENT DOCUMENTS

| | | | |
|---|---|---|---|
| 3,571,956 | 3/1971 | Heiberg | 37/193 X |
| 4,040,261 | 8/1977 | Schuck et al. | 37/DIG. 18 X |
| 4,200,410 | 4/1980 | Baker et al. | 37/193 X |

*Primary Examiner*—E. H. Eickholt

*Attorney, Agent, or Firm*—Cullen, Sloman, Cantor, Grauer, Scott & Rutherford

[57] ABSTRACT

A vertical lift and blade control mechanism for a plow blade which is particularly suitable for a vibratory plow assembly used for laying cable, pipe, and the like underground. The blade control mechanism is generally in the form of a parallelogram frame assembly including substantially equal length vertical frame members which are parallel and interconnected by links to form a four bar linkage arrangement that is collapsible for adjustable movement of the plow blade. The frame assembly is pivotally connected at one corner to a rigid mast assembly, and a first piston cylinder is connected between the mast assembly and frame assembly for raising and lowering the plow blade between a generally vertical plowing position and a transport position. The vertical frame members are shifted relative to each other by a second piston cylinder to provide variable digging depths for the plow blade. Thus, the plow blade may be raised, lowered or tilted by operation of the lift and blade control mechanism to adjust the digging depth and attack angle of the plow blade. Further, in a transport position, the second piston cylinder may be extended to shift the center of gravity for the plow assembly forwardly thereby providing greater stability to the assembly during transport.

2 Claims, 5 Drawing Figures

VERTICAL LIFT AND BLADE CONTROL MECHANISM FOR CABLE PLOWS

BACKGROUND OF THE INVENTION

The present invention relates generally to a lift and control mechanism for plows. The lift and control mechanism of this invention is particularly useful in cable laying plows which lay a continuous length of cable, flexible pipe, or the like underground at a desired depth.

Cable laying plows of the type disclosed herein having an elongated vertical blade have been used for several years to lay cable, flexible pipe and the like underground. The cable or pipe may be either pulled through the cut of the plow blade or a cable chute may be provided on the trailing edge of the blade which guides the cable into the ground from a drum mounted on the prime mover. Various types of vibrators or shakers have been mounted on the plow blade or supporting frame which effectively reduces the drawbar pull or force required to pull the blade through the ground.

While cable laying plows have been successful in reducing labor costs because of speed of application and in reducing damage to the work site, the cable may be damaged in certain applications where buried objects such as rocks and large tree roots are encountered by the blade. In a conventional cable laying plow, the blade is rigidly supported generally along the longitudinal axis of the prime mover. The attack angle of the blade cannot, therefore, be adjusted and the cable may be damaged if the blade encounters large rocks, tree roots and the like. Thus, there has been a need for a convenient and effective mechanism for lifting or lowering the blade so as to clear buried objects while maintaining proper plowing attitude.

Another problem with cable plows arises because the blade is of a fixed length and sometimes the fixed length blade is unable to reach the required depth when the machine is traversing a hilly terrain. Thus, there has been a need for an adjustable cable laying plow frame that permits varying digging depths when traversing uneven terrain.

Further, in many commercial cable laying plows, the entire plow assembly is not easily raised for transport. Since cable plows are relatively large and heavy apparatus, it is desirable to have a lift mechanism that operates simply for raising the plow frame for transport.

The disadvantages of conventional cable laying plows have resulted in the present lift and control mechanism which enables the operator to manipulate the plow blade to clear buried objects, permits variable digging depths, and permits easy transport of the plow assembly.

SUMMARY OF THE INVENTION

The cable laying plow assembly disclosed herein includes a prime mover and a generally vertically extending plow blade. The elongated vertical plow is particularly suitable for laying cable or flexible pipe underground. The prime mover may be a conventional tractor and the plow blade may be supported on a suitable support frame. Where the vertical lift and blade control mechanism of this invention is utilized in a vibratory plow, the plow blade may be supported on a frame assembly which isolates the vibrations from the prime mover, such as disclosed in U.S. Pat. No. 3,618,237, which patent is incorporated herein by reference.

Generally, the vibratory cable plow assembly disclosed herein includes a vertical mast assembly rigidly attached to a rear frame portion of the tractor, a vertical lift and blade control mechanism made in accordance with the present invention, a blade support or frame, and an elongated plow blade. The blade support is adapted to vibrate the blade and transmit arcuate or orbital motion to the blade tip. A conventional vibrator is mounted on a pivotally supported yoke which is pivotally mounted by links to the lift and blade control mechanism for the blade.

The vertical lift and blade control mechanism of the present invention includes a polygonal frame assembly having piston cylinders for enabling the operator to raise and lower the digging depth of the plow blade from the operator's seat. The blade control mechanism is generally in the form of a parallelogram including substantially equal length vertical frame members which are parallel and interconnected by links to form a four bar linkage arrangement that is collapsible for adjustable movement of the blade relative to the fixed mast assembly.

One corner of the frame assembly is pivotally attached to the upper end of the mast assembly. A first piston cylinder is connected between the lower end of the mast assembly and a vertical frame member of the lift and blade control mechanism for raising and lowering the blade control mechanism, blade frame, and plow blade between a generally vertical plowing position and a transport position.

The vertical frame members of the blade control mechanism are shifted relative to each other by a second piston cylinder connected between the frame members. This, in turn, raises and lowers the blade support and blade for providing variable digging depths. Further, in a transport position, the second piston cylinder may be extended to shift the center of gravity for the vibratory cable plow assembly forwardly thereby providing greater stability to the assembly during transport.

Thus, the plow blade may be raised, lowered, or tilted by operation of the lift and blade control mechanism. Extension of the second piston cylinder connecting the vertical frame members raises the plow blade for clearing buried objects or reducing digging depth while maintaining proper plowing attitude. This enables the operator to clear buried rocks, tree roots, and the like that might otherwise cause damage to the cable being laid. When the second piston cylinder is retracted, the plow blade is lowered for maintaining proper plowing depth over uneven terrain. If the first piston cylinder between the mast assembly and blade control mechanism frame is fully extended, the cable plow assembly is pivoted to a transport position. Then, the second piston cylinder may be extended for shifting the weight and center of gravity of the plow assembly forwardly thereby giving greater stability to the assembly during transport.

Further, the plow blade may be tilted or canted by remote control from true vertical by partially extending or retracting the first piston cylinder. Rearward tilt of the plow blade while the blade is being raised reduces the tendency for additional cable to be drawn through the cable guide thereby reducing cable damage from bending. Another advantage of the tiltable lift and blade control mechanism is the ability to adjust the attack angle of the plow blade to compensate for varying soil conditions without physically repositioning the blade with respect to the blade support.

Other advantages and meritorious features of the vertical lift and blade control mechanism of the present invention will be more fully understood from the following description of the invention, the appended claims, and the drawings, a brief description of which follows.

DETAILED DESCRIPTION OF THE INVENTION

Figure 1:
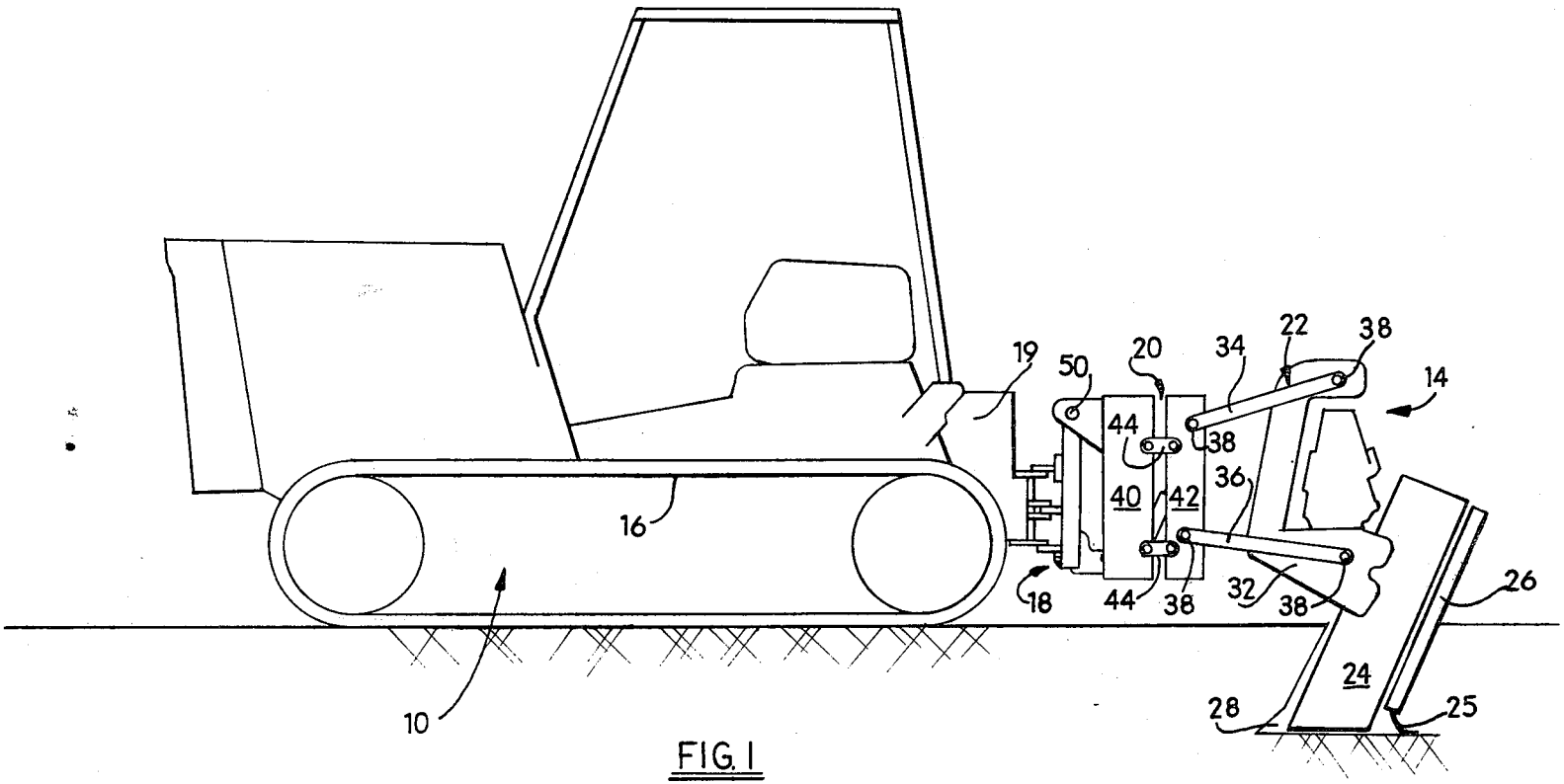
FIG. 1 is a side elevation of a vibratory cable laying plow which includes the vertical lift and blade control mechanism of the present invention.

The embodiment of the cable laying plow shown in FIG. 1 generally includes a prime mover 10 and a vibratory plow assembly 14. It will be understood that the prime mover may be any suitable machine, including a tractor or the like. The disclosed embodiment of the prime mover is a conventional tractor 10 having continuous tracks 16. Generally, the vibratory plow assembly 14 includes a vertical mast assembly 18 rigidly attached to tractor rear frame portion 19, a lift and blade control mechanism 20 made in accordance with the present invention, a blade support or frame 22, and an elongated blade The cable laying plow of this invention may be utilized to lay cable, flexible pipe or hose underground. Cable 25 is fed through a guide or cable chute 26 into the cut made by the plow blade 24. The blade support or frame 22 is adapted to vibrate blade 24 and transmit an arcuate or orbital motion to the blade tip or toe 28. A conventional vibrator 30 is mounted on a pivotally supported yoke 32 which is pivotally mounted by upper and lower pairs of links 34 and 36 to the lift and blade control mechanism 20 for blade 24. The opposed ends of links 34, 36 are pivotally supported on pins 38 which may include resilient elastomeric bearing elements as is conventional. Thus, vibrations are transmitted from shaker 30 through yoke 32 to blade 24 resulting in arcuate or orbital motion of the blade in the ground.

Since the remaining elements to be described are duplicated on opposite sides of tractor 10, only one set of elements has been shown with the understanding that the description will likewise refer to an identical set of elements located on the opposite side of tractor 10.

The lift and control mechanism 20 for blade 24 is shown in detail in FIGS. 2–5. As shown, the lift and blade control mechanism 20 includes a pair of generally vertical frame members 40 and 42 which are parallel and interconnected by links 44 to form a four bar linkage arrangement. Links 44 are connected between frame members 40 and 42 at their opposite ends by pins 46 to permit shifting of frame member 42 relative to frame member 40 for adjustable movement of blade 24 relative to fixed mast assembly 18. Frame member 40 includes a mounting plate 48 which is pivotally attached by pin 50 to the upper end of mast assembly 18.

The lift and blade control mechanism 20, blade frame 22, and blade 24 are simultaneously raised and lowered by actuation of a piston cylinder 52 which is connected at one end to frame member 40 by pin 54 and at its opposite end to mast assembly support 56 by pin 58. Lift cylinder 52 is retracted to lower frame member 40 to a generally vertical position as illustrated in FIGS. 2–4 or extended to lift frame member 40 and blade 24 to a transport position as illustrated in FIG. 5.

Frame member 42 is shifted relative to frame member 40 by piston cylinder 60 which is pivotally mounted at one end by pin 62 to frame member 40 and at its opposite end to frame member 42 by pin 64. The blade frame 22 and attached blade 24 may be raised and lowered as illustrated in FIGS. 2–4 for providing variable digging depths by actuating piston cylinder 60. Further, in a tansport position, as illustrated in FIG. 5, piston cylinder 60 may be extended to shift the center of gravity for the vibratory cable plow assembly 14 forwardly thereby providing greater stability to the assembly during transport.

Figure 2:
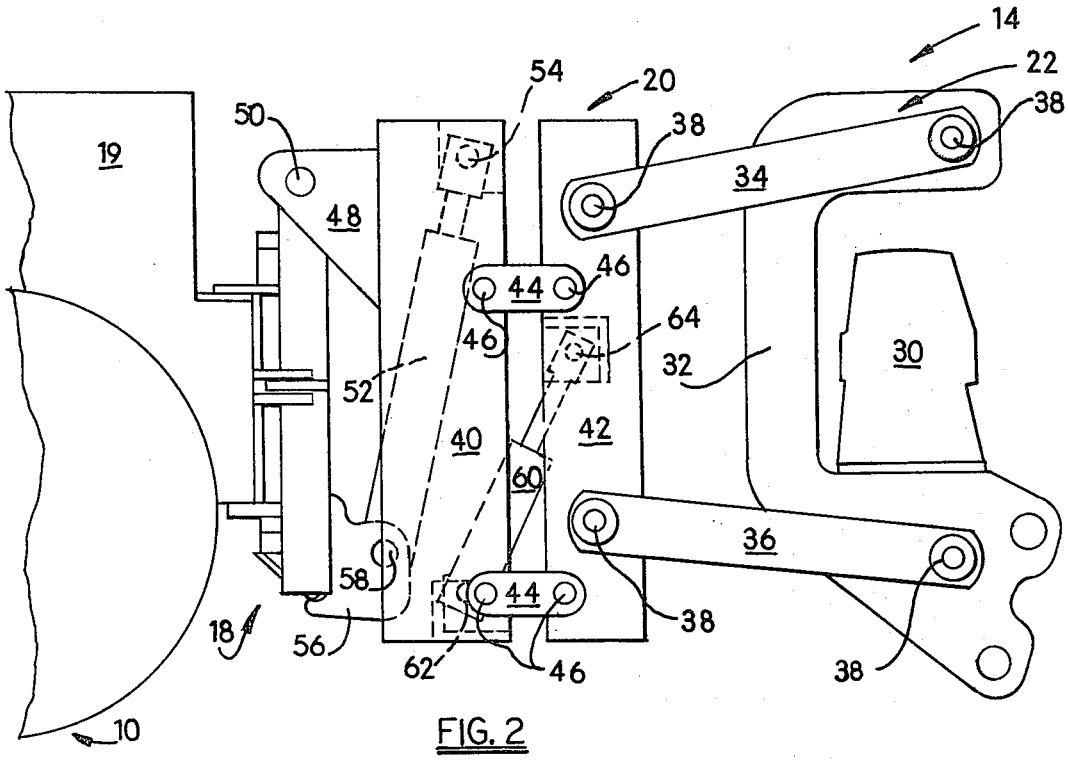
FIG. 2 is an enlarged side elevation of the lift and blade control mechanism with the plow blade in its normal plowing position.
Figure 3:
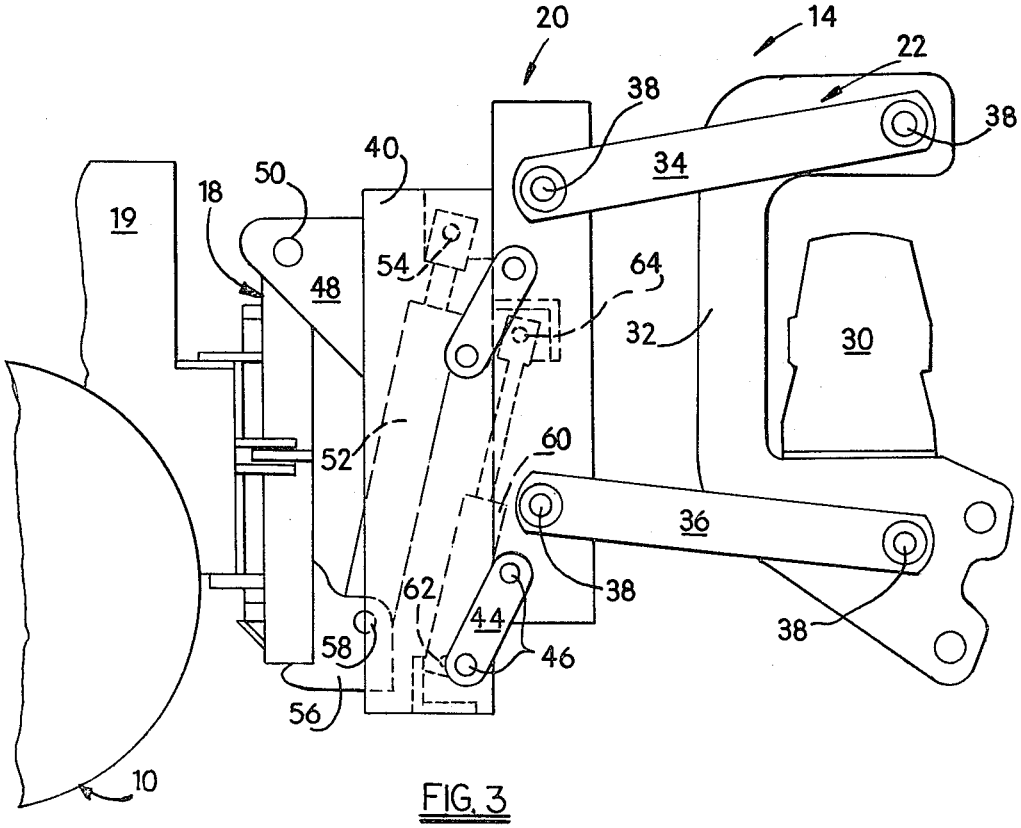
FIG. 3 is an enlarged side elevation of the lift and blade control mechanism in a position for permitting the plow blade to clear buried objects and reduce digging depth.
Figure 4:
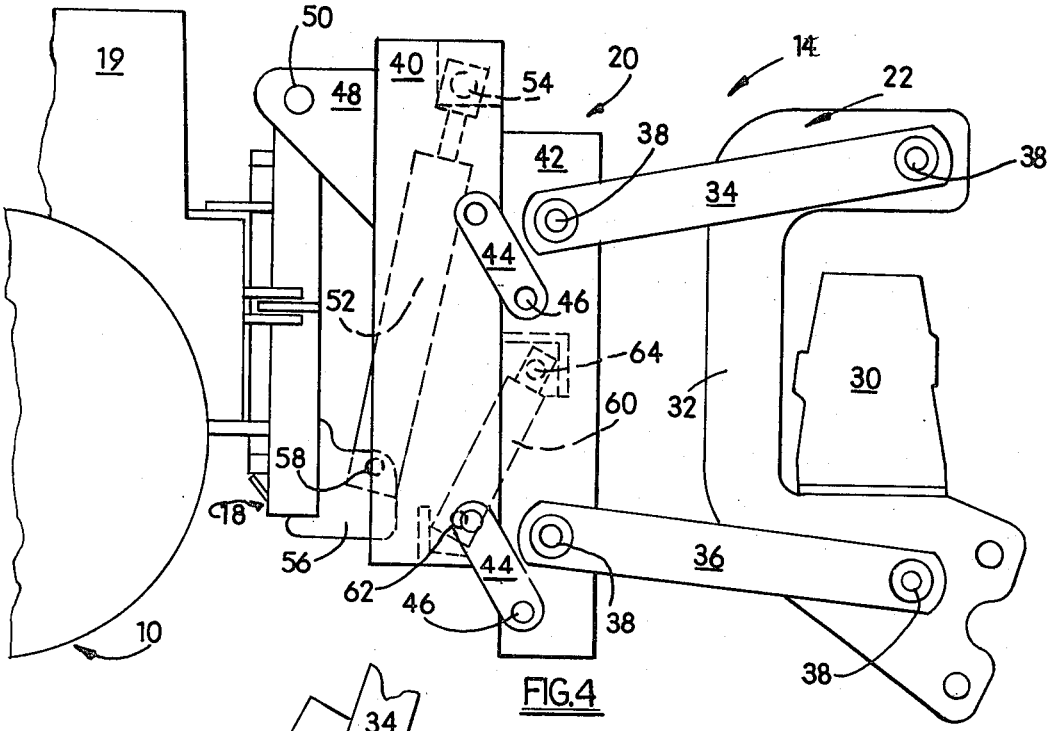
FIG. 4 is an enlarged side elevation of the lift and blade control mechanism in a lowered position permitting deeper digging depths by the plow blade.

The operation of the disclosed vibratory cable laying plow may be understood by referring to FIGS. 2–5. FIG. 2 illustrates the plow assembly 14 in a normal plowing position. The blade 24 may be raised, lowered, or tilted from the position illustrated in FIG. 2 by operation of the lift and blade control mechanism 20. Referring to FIG. 3, extension of piston cylinder 60 raises blade 24 for clearing buried objects or reducing digging depth while maintaining proper plowing attitude. This enables the operator to clear buried objects that might otherwise cause damage to cable 25. When piston cylinder 60 is retracted, as illustrated in FIG. 4, plow blade 24 will be lowered for maintaining proper plowing depth over uneven terrain.

Figure 5:
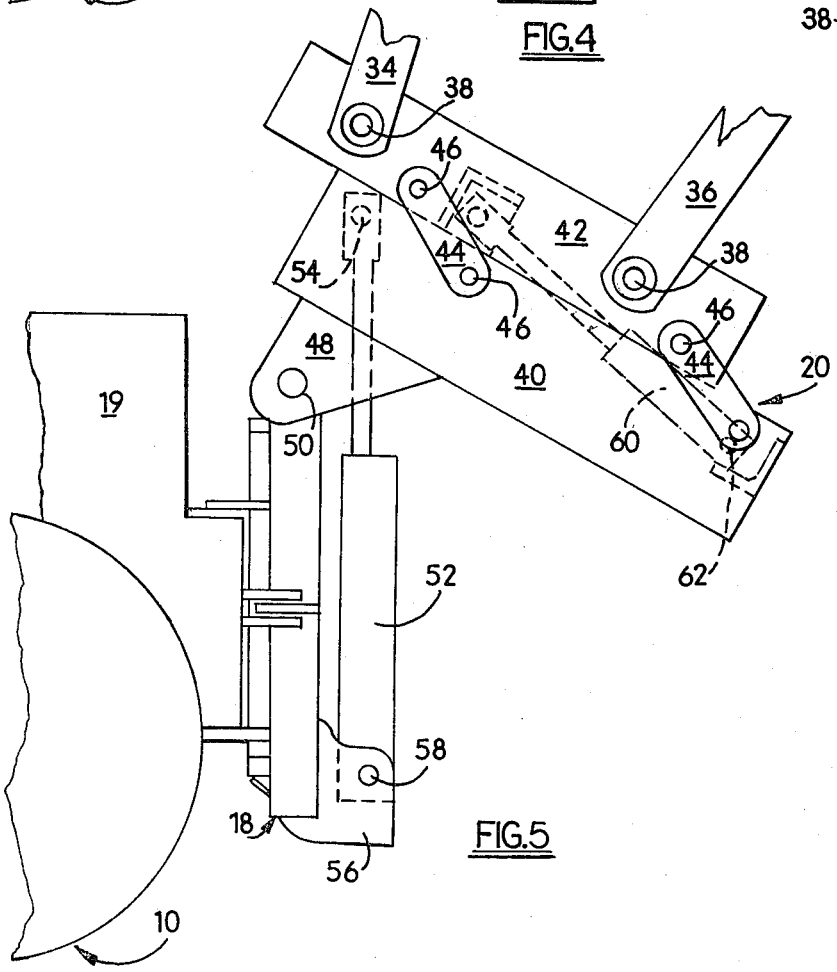
FIG. 5 is an enlarged side elevation of the blade control mechanism and plow blade assembly in a transport position.

If piston cylinder 52 is fully extended as shown in FIG. 5, the plow assembly 14 is moved to a transport position and piston cylinder 60 is extended for shifting the weight and center of gravity of plow assembly 14 forwardly thereby giving greater stability to the assembly during transport. Further, plow blade 24 may be tilted relative to true vertical by extending or retracting piston cylinder 52 for the purpose of reducing the possibility of cable damage from bending stresses and for varying the attack angle of the blade to compensate for varying soil conditions, thereby providing an additional advantage for the vibratory cable plow of this invention.

It will be apparent to those skilled in the art that the foregoing disclosure is exemplary in nature rather than limiting, the invention being limited only by the appended claims.

We claim:

1. In a cable laying plow for laying cable, pipe and the like underground including a prime mover, an elongated plow blade mounted on a blade support frame, said blade support frame having a vibrator for transmitting orbital motion to said plow blade, the improvement comprising:

a vertical lift and plow blade control mechanism for said plow blade including a frame assembly having vertical, side-by-side, frame members which are pivotally interconnected by link means to form a four bar linkage arrangement that is collapsible for adjustable movement of said plow blade;

said frame assembly being pivotally connected to the upper end of a vertical mast assembly which is rigidly mounted to a rear frame portion of said prime mover, said blade support frame being connected to said frame assembly, a first piston cylinder connected between said mast assembly and said frame assembly for raising and lowering said plow blade between a generally vertical plowing position and a transport position, and a second piston cylinder connected between said frame members for shifting said frame members relative to each other thereby raising and lowering said blade support and plow blade for providing variable digging depths; and wherein said frame members being substantially parallel and a first of said frame members including a mounting plate pivotally connected to the upper end of said vertical mast assembly, said first piston cylinder being connected between the lower end of said mast assembly and said first frame member, said blade support frame including upper and lower links pivotally connected at one end to a second of said frame members, the lift and plow blade control mechanism, blade support frame, and plow blade being simultaneously raised to a transport position upon extension of said first piston cylinder, and said second piston cylinder being extended in said transport position for shifting the center of gravity of said blade support frame and plow blade forwardly toward said prime mover thereby providing greater stability during transport.

2. The cable laying plow as defined in claim 1 wherein said blade support frame and plow blade being tilted relative to vertical by extending or retracting said first piston cylinder for varying the attack angle of said plow blade to compensate for varying soil conditions.

* * * * *